US005479895A

United States Patent [19]

Rusconi

[11] Patent Number: 5,479,895

[45] Date of Patent: Jan. 2, 1996

[54] DUAL VALVE ENGINE PROTECTIVE DEVICE

[75] Inventor: David M. Rusconi, Redwood City, Calif.

[73] Assignee: Triangle Engineered Products Co., Bensenville, Ill.

[21] Appl. No.: 390,083

[22] Filed: Feb. 17, 1995

[51] Int. Cl.[6] ..... F01P 5/14

[52] U.S. Cl. ..... 123/41.15; 123/198 D

[58] Field of Search ..... 123/41.15, 198 D, 123/198 DB

[56] References Cited

U.S. PATENT DOCUMENTS

| | | | |
|---|---|---|---|
| 3,138,144 | 6/1964 | Armbrust | 123/41.15 |
| 3,261,336 | 7/1966 | St. Lucas et al. | 123/41.15 |
| 3,518,887 | 3/1970 | Armbrust | 123/41.15 |
| 3,533,391 | 10/1970 | Lockmuller | 123/41.15 |
| 3,817,224 | 6/1974 | Pluequet et al. | 123/41.15 |
| 3,841,291 | 10/1974 | Ludewig et al. | 123/41.15 |
| 3,958,548 | 5/1976 | Koci et al. | 123/41.15 |
| 4,615,303 | 10/1986 | Sackett | 123/41.15 |
| 5,111,785 | 5/1992 | Frase | 123/41.15 |

*Primary Examiner*—Noah P. Kamen
*Attorney, Agent, or Firm*—Leydig, Voit & Mayer, Ltd.

[57] ABSTRACT

A protective device is provided for discontinuing the operation of an internal combustion engine having two banks of cylinders, each cylinder bank having an associated pressurized cooling circuit. Each cooling circuit has a separate pump which circulates liquid coolant by increasing the coolant fluid pressure at the pump outlet relative to the pump inlet. The protective device comprising: a pressure detector; a first valve connected to the outlet of each pump and having a biasing means for communicating the lower of the two pump outlet pressures to the pressure detector; a second valve connected to the inlet of each coolant pump and having a biasing means for communicating the higher of the two pump inlet pressures to the pressure detector; and an engine shutdown mechanism which is actuated by the pressure detector for terminating engine operation should the pressure differential between the outlet pressure and the inlet pressure communicated to the pressure detector become less than a reference (airbox) pressure.

10 Claims, 4 Drawing Sheets

DUAL VALVE ENGINE PROTECTIVE DEVICE

BACKGROUND OF THE INVENTION

1. Field of the Invention

The present invention relates generally to internal combustion engines and, more particularly, concerns a protective device which automatically shuts down an engine having two banks of cylinders and an associated cooling circuit for each bank in the event of inadequate coolant flow to either bank of the engine. The present invention is especially suitable for use in certain dual-sided diesel locomotive engines.

2. Description of the Prior Art

Many internal combustion engines employ a closed, pressurized cooling circuit to permit engine operation at elevated temperatures and pressures. Such cooling circuits typically include: a coolant fluid; a pump which circulates the coolant through the engine by increasing its pressure; and a radiator which reduces the temperature of the coolant after it has passed through the engine so that it may be recirculated through the engine.

Since engine damage can be prevented or minimized if engine operation is terminated should there be a malfunction in the cooling circuit, several protective devices have been developed which are well known in the art. Typically, these devices monitor designated pressures within the cooling circuit and activate an alarm or an engine discontinuation mechanism if coolant pressures deviate significantly from normal. In an exemplary protection device, failure of a cooling pump could cause a pressure aberration sufficient to trigger an engine shut down or actuate an alarm.

Such devices, however, often suffer from a number of shortcomings, including the inability to function properly if they are used in conjunction with more than a single cooling circuit. For example, U.S. Pat. No. 3,958,548, issued to Koci et al. on May 25, 1976, discloses an engine protective device for use in an engine with a single cooling circuit. In particular, Koci teaches an apparatus which utilizes a diaphragm-type detector device to continuously monitor the inlet and outlet pressures of the cooling pump, as well as the pressure in the engine airbox. Engine operation is discontinued if the pressure differential across the cooling pump becomes less than the airbox pressure. Koci does not disclose the use of more than a single cooling circuit, nor does the Koci patent disclose the use of an apparatus to connect an additional cooling circuit to the detector. Indeed, to adequately protect a diesel locomotive engine with two banks of cylinders and having a cooling circuit associated with each bank, two Koci diaphragm detector mechanisms would be required, one for each bank. On the other hand, should a single Koci device be connected to one circuit of an engine having two cooling circuits, and should there be a failure in the unconnected circuit, the detector will not monitor the pressure gradient across the failed pump, engine operation will not be discontinued, and the engine will likely overheat and suffer damage.

OBJECTS AND SUMMARY OF THE INVENTION

The primary object of the present invention is to provide a mechanism which shuts down an internal combustion engine in the event of a cooling system failure.

A more detailed object of the invention is to provide a protective mechanism for an internal combustion engine having two banks of cylinders and an associated cooling circuit for each bank which discontinues engine operation should there be inadequate coolant flow to either bank of the engine.

A further object of the present invention is to furnish a protective mechanism for a diesel locomotive engine having two banks of cylinders and an associated cooling circuit and pump for each bank which continually monitors coolant flow pressures in both banks of cylinders and which employs two valves and a pressure detection device to terminate engine operation in the event of a cooling pump failure in either circuit of the engine.

A supplemental object of the present invention is to provide an engine protective mechanism which is simple and inexpensive to make and install, and which is reliable and convenient to use.

These objects are achieved by: a pressure detector; a first valve connected to the outlet of each of two coolant pumps; and a second valve connected to the inlets of each coolant pump. The first valve has a mechanism for communicating the lower of the two pump outlet coolant pressures to the pressure detector, while the second valve has a mechanism for communicating the higher of the two pump inlet coolant pressures to the pressure detector. An engine shutdown means is actuated by the pressure detector, and discontinues engine operation, should the pressure differential between the outlet pressure and the inlet pressure communicated to the pressure detector become less than a reference pressure.

These and other features and advantages of the invention will become apparent upon reading the following description of a preferred exemplified embodiment of the invention, and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the appended claims.

DETAILED DESCRIPTION OF THE PREFERRED EMBODIMENT

Figure 1:
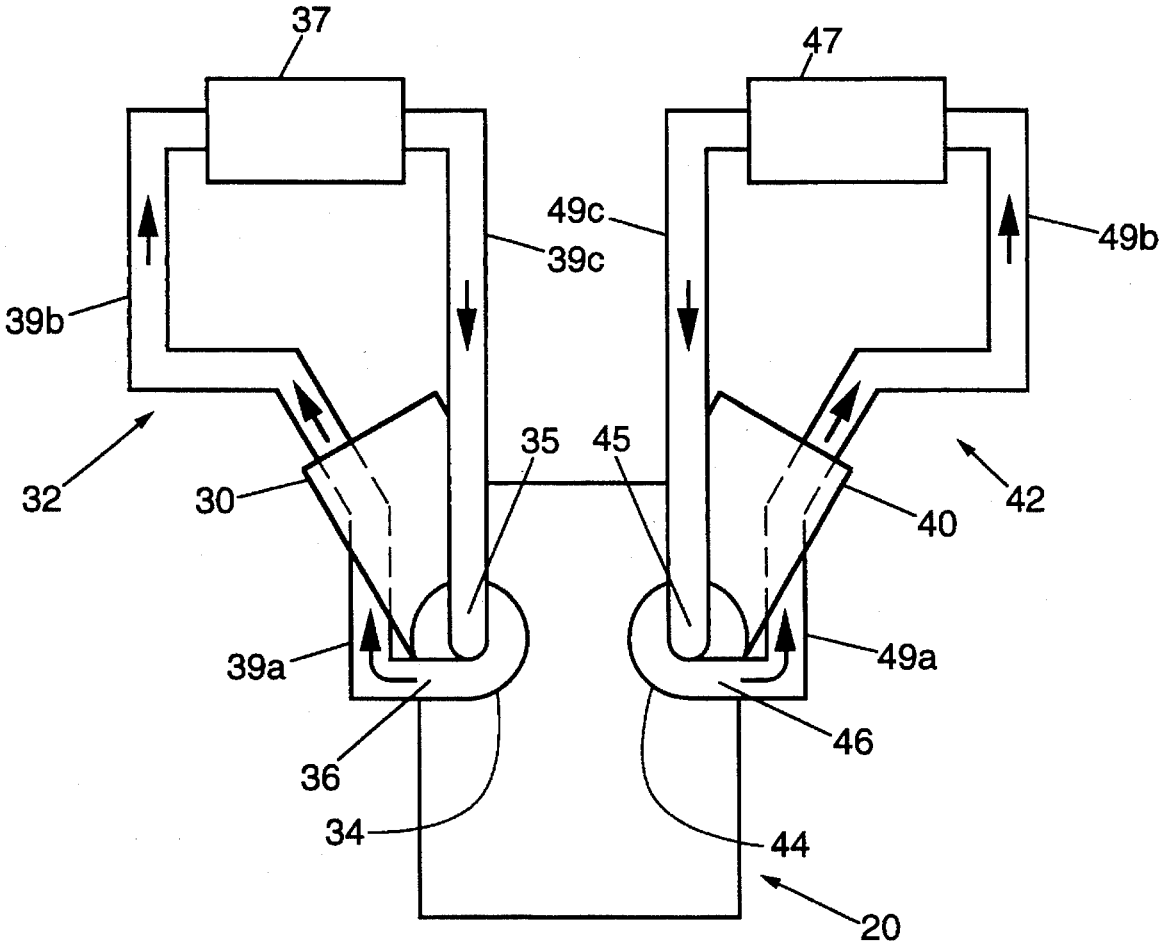
FIG. 1 is a schematic representation of an unprotected internal combustion engine having two banks of cylinders and an associated pressurized cooling circuit for each bank.

Turning now to the drawings, FIG. 1 shows a schematic representation of an unprotected internal combustion engine 20 having two banks of cylinders 30, 40 and a pressurized cooling circuit 32, 42 associated with each bank 30 and 40, respectively. In the illustrated embodiment, the two cooling circuits 32, 42 are separate, inasmuch as the left circuit 32 cools the left bank 30 of the engine 20 while the right circuit independently cools the right bank 40 of the engine 20.

Referring specifically to the left cooling circuit 32, it will be understood by those skilled in the art that internal cooling passages (depicted generally by phantom lines) disposed in the left bank 30 of the engine 20 are connected externally to a pump 34 by coolant line 39*a* and to a radiator 37 by coolant line 39*b*. It will be further understood that the pump 34 has an inlet 35, connected to receive coolant from the radiator 37, and an outlet 36, connected to deliver the coolant under pressure to the left bank 30 of the engine 20. An exemplary pump 34—as described, for instance, in Koci et al., U.S. Pat. No. 3,958,548—is driven by the engine 20 and thus operates at a speed which varies proportionally with engine speed.

In operation, the pump 34 raises the coolant pressure at the pump outlet 36 relative to the pump inlet 35, which causes the coolant to circulate through the circuit 32. As pump speed increases, the pressure differential between the pump outlet 36 and the pump inlet 35 increases which, in turn, increases the rate at which coolant flows through the circuit 32. Thus, the pressure differential across the pump 34 provides a reliable indication of the rate of coolant flow through the coolant circuit 32 at any given time. For instance, as long as the pump 34 is functioning properly and sufficient coolant is flowing through the circuit 32, the pressure differential across the pump 34 will remain detectably positive. Should the pump 34 malfunction or should there be inadequate coolant flowing through the circuit 32, the pressure gradient across the pump 34 will be significantly and detectably reduced (or will go to zero).

The coolant circulates through the left circuit 32 as generally indicated by the arrows in FIG. 1. After being pressurized by the pump 34, the coolant flows from the pump outlet 36 to the left cylinder bank 30, where heat is transferred from the engine 20 to the coolant, thereby simultaneously decreasing the temperature of the engine 20 and increasing the temperature of the coolant. From the cylinder bank 30, the coolant flows to the radiator 37 through line 39*b*. While in the radiator 37, the temperature of the coolant is reduced by heat transfer to atmosphere. After leaving the radiator 37, the coolant flows through line 39*c* to the pump inlet 35. The pump 34 re-pressurizes the coolant, and the coolant is recirculated. Unless there is a failure in the circuit 32 during engine operation, occasioned, for example, by a malfunction in the pump 34, the above-described thermodynamic cycle will continue uninterrupted.

It will be understood that the right cooling circuit 42 operates in the same manner as the left cooling circuit 32 and has the same components, including a pump 44 (with an inlet 45 and an outlet 46), a radiator 47, coolant lines 49*a*–49*c*, and a coolant fluid.

Although the two cooling circuits 32, 42 illustrated in FIG. 1 and discussed above are completely independent, it will be readily apparent to those skilled in the art that they need not be entirely separate. Instead, the left and right cooling circuits 32, 42 may combine or merge at various points so as to facilitate the temporary intermixing of coolant fluids from the two circuits. For example, coolant lines 39*b* and 49*b* may be linked such that the coolant leaving the left and right banks 30, 40 is combined before entering the radiators 37, 47. Alternatively, or in combination, coolant lines 39*c* and 49*c* may be linked such that the coolant leaving the radiators 37, 47 is merged and mixed prior to entering the pump inlets 35, 45.

Figure 2:
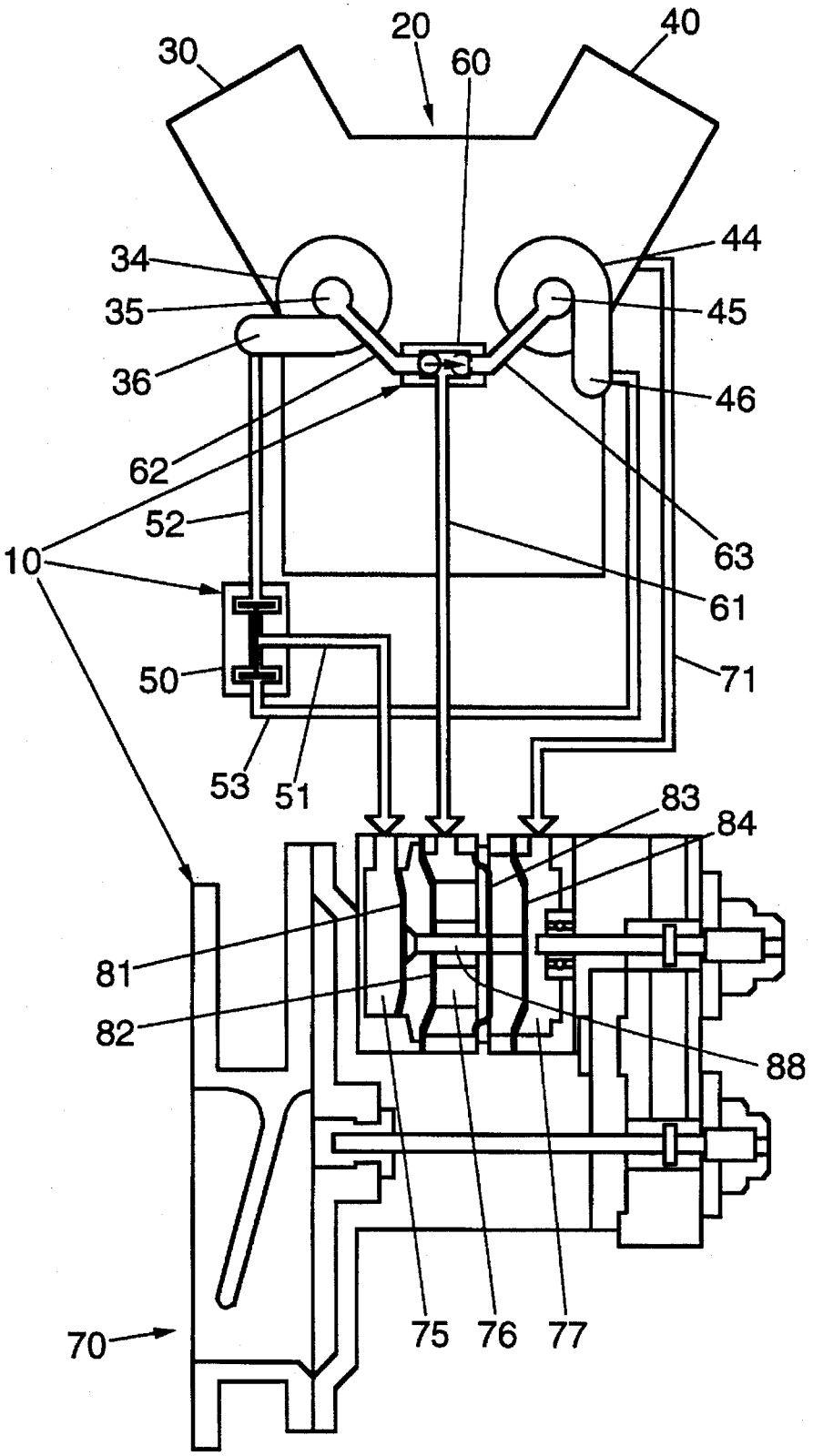
FIG. 2 shows the protective device of the present invention comprising a first (discharge selector) valve, a second (inlet selector) valve, and a pressure detector mechanism as applied to the engine of FIG. 1.

FIG. 2 shows the engine protective device 10 of the present invention as applied to the engine 20 illustrated in FIG. 1. The protective device 10 includes a first valve 50, a second valve 60, and a pressure detector 70.

Figure 3:
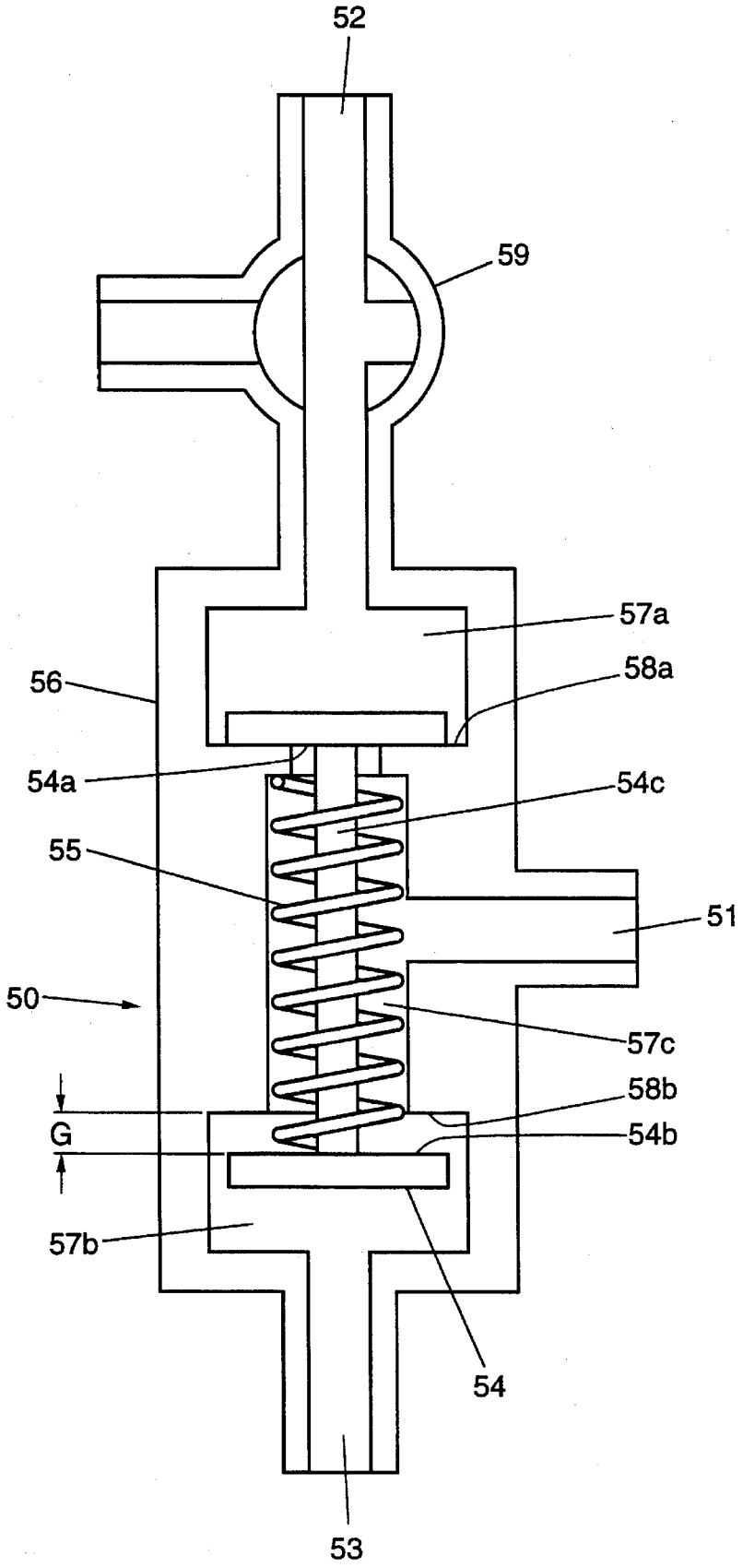
FIG. 3 is an enlarged cross-sectional view of the discharge selector valve of the present invention.

The first valve 50 is connected to the outlet 36 of the left bank pump 34 as well as to the outlet 46 of the right bank pump 44 and has a biasing mechanism, as described more fully below, which is responsive to pressure gradients and which ensures that the lower of the two pump outlet pressures is in fluidic communication with the detector 70. In the embodiment depicted in FIGS. 2 and 3, the first valve 50 has an outer housing 56 which defines, in cross-section, a generally H-shaped central chamber having three compartments 57*a*, 57*b*, and 57*c*. As is best shown in FIG. 3, the first compartment 57*a* is connected to the outlet 36 of the left bank pump 34 via port 52, the second compartment 57*b* is connected to the outlet 46 of the right bank pump 44 via port 53, and the intermediate compartment 57*c* —disposed between the first and second compartments 57*a* and 57*b* and having a smaller cross-sectional area—is connected to the pressure detector 70 via port 51. Two stops or shoulders 58*a* and 58*b* are defined by the intersection of the first and second compartments 57*a*, 57*b*, respectively, and intermediate compartment 57*c*. A valve shuttle 54 having a central stem portion 54*c* and two surfaces 54*a*, 54*b* reciprocates within the central chamber 57. Ideally, the stem 54*c* is slightly longer than the longitudinal length of the third compartment 57*c* (so as to permit the shuttle 54 to translate back-and-forth between the two shuttle stops or shoulders 58*a*, 58*b*), and the two surfaces 54*a*, 54*b* are slightly smaller in diameter than the interior diameters of the first or second compartments 57*a*, 57*b*. A spring 55 is compressibly disposed about the inner stem 54*c* of the valve shuttle 54, as illustrated in FIG. 3. The spring 55 biases the shuttle 54 such that the outlet pressure from the right bank pump 44 is in fluidic communication with the pressure detector 70 through ports 53 and 51.

Under normal operating conditions, the spring 55 urges surface 54*a* against stop 58*a* such that a gap G opens between surface 54*b* and stop 58*b*, as depicted in FIG. 3. In this way, a flow path is formed from the outlet 46 of the right bank pump 44, through port 53, through the second compartment 57*b*, through the third compartment 57*c*, through port 51, and to the detector 70. Should the pressure in line 52 (i.e. the outlet pressure from the left bank pump 34) fall appreciably below the pressure in line 53 (i.e. outlet pressure from the right bank pump 44), the biasing provided by spring 55 will be overcome and surface 54*b* will be urged against stop 58*b*, thereby closing the flow path through line 53. The outlet pressure from the left bank pump 34 will then be in communication with the pressure detector 70 through ports 52 and 51 (i.e. a flow path is formed from the left bank pump outlet 36, through port 52, through the first compartment 57*a*, through the third compartment 57*c*, through port 51, and to the detector 70). Should either pump malfunction or fail, the shuttle 54 will thus be positioned such that the outlet pressure from the malfunctioning or failed pump will be sensed by the detector 70.

Figure 4:
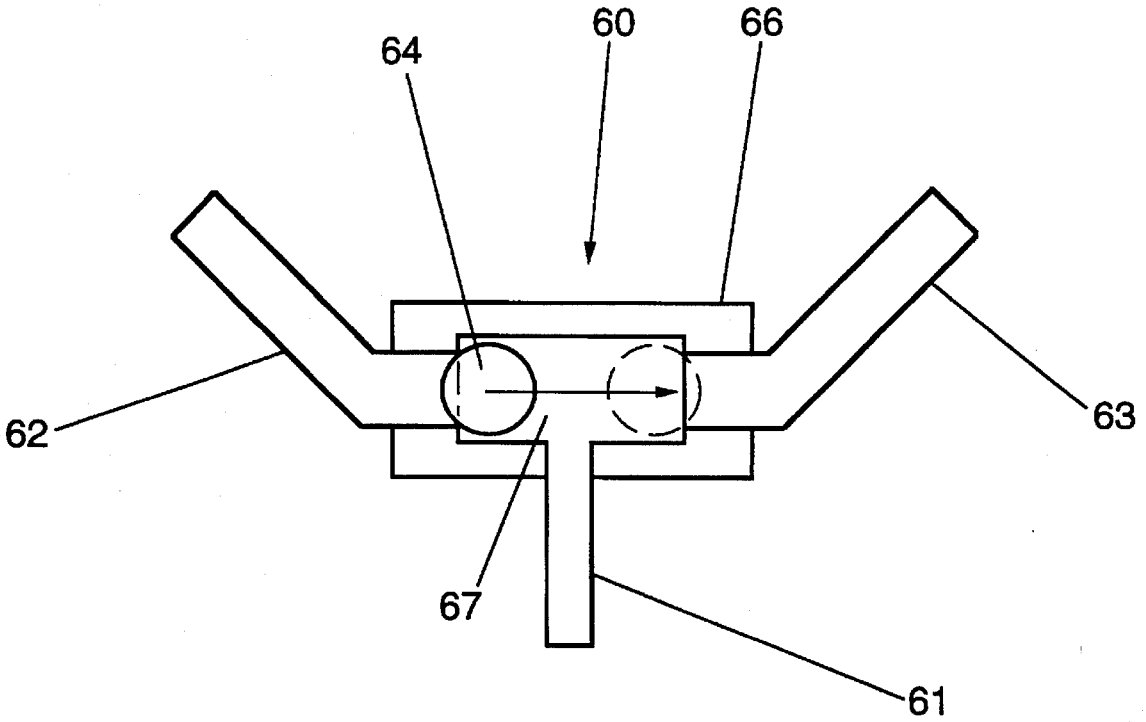
FIG. 4 is an enlarged cross-sectional view of the inlet selector valve of the present invention.

The second valve 60 is connected to the left and right bank pump inlets 35, 45, and has a biasing means for communicating the higher of the two pump inlet pressures to the detector 70. In the illustrated embodiment, the second valve 60 is a conventional check-valve, and is well known in the art. As best shown in FIG. 4, the second valve 60 has an outer housing 66 defining a generally cylindrical central chamber 67. A valve ball 64, disposed within the housing 66, is free to move between the two ends of the chamber 67, corresponding to ports 62 and 63, respectively. In operation, the check-valve 60 receives the inlet pressure from the left bank pump 34 through port 62 and the inlet pressure from the right bank pump 44 through port 63. Being responsive to the two inlet pressures, the ball 64 is positioned within the valve 60 such that the higher of the two pump inlet pressures urges the ball 64 against the opposite port. Should the inlet pressure from the right bank pump 44 therefore be greater than the inlet pressure from the left bank pump 34, the resulting pressure differential will urge the ball 64 against port 62, as portrayed by the solid lines in FIGS. 2 and 4, thereby closing the flow path through line 62. In this case, the inlet pressure from the right bank pump 44 will communicate with the detector 70 through ports 63 and 61. Should the inlet pressure from right bank pump 44 become less than the inlet pressure from the left bank pump 34—which would occur, for instance, if the left bank pump 34 were to fail—the pressure differential will urge the ball 64 against port 63, as indicated by the phantom lines in FIGS. 2 and 4. In this case, the flow path though line 63 is closed and the inlet pressure from the left bank pump 34 will communicate with the detector 70 through ports 62 and 61. Accordingly, should either pump fail, the ball 64 will be positioned within the check-valve 60 such that the inlet pressure from the failed pump (i.e. the higher of the two pump inlet pressures) will communicate with the detector 70.

The pressure detector 70 receives the pressures supplied by the two valves 50, 60, as well as a reference engine pressure. Preferably, the reference pressure increases in proportion to engine speed. In two-cycle diesel locomotive engines, for example, the engine airbox (not shown) provides a suitable reference pressure. The airbox is essentially a plenum, pressurized by a blower or an exhaust drive supercharger (not shown), which supplies fresh, pressurized air for combustion to the inlets of the cylinder banks 30, 40.

In operation, the pressure detector 70 continuously monitors the pressure from the first valve 50 (i.e. the lower of the pump outlet pressures) and compares it with the pressure from the second valve 60 (i.e. the higher of the pump inlet pressures). Should the pressure differential between these two sources becomes less than the airbox pressure, the pressure detector 70 actuates an engine shut down mechanism (not shown) which terminates engine operation. In the illustrated embodiment, the pressure detector 70 is a diaphragm type detector such as that disclosed in Koci et al., U.S. Pat. No. 3,958,548. This type of pressure detector, which is well known in the art, generally comprises a series of chambers 75–77 defined by a plurality of substantially parallel diaphragms 81–84. As delineated in FIG. 2, the first chamber 75 is connected to the first valve 50 by line 51, the second chamber 76 is connected to the second valve 60 by line 61, and the third chamber 77 is connected to the engine airbox by line 71. Disposed between the first and third diaphragms 81, 83 is a member 88 which is perpendicular to plane of the diaphragms 81–84. In the event that either pump 34, 44 fails during engine operation, the pressure differential between the first chamber 75 and the second chamber 76 (i.e. the pressure gradient across the malfunctioning pump) will fall to zero, but the pressure in the third chamber 77 (i.e. the pressure from the airbox) will remain positive. Upon such an occurrence, the net change in the resulting forces acting on the diaphragms urges member 88 leftwardly which, in turn, activates the engine shut down mechanism.

In an alternative form of the invention, the discharge selector valve 50 may further comprise a manual-override for simulating a failure in the left bank pump 34, thus permitting an engine operator to stop engine operation in the event of a non-coolant related engine failure. In the illustrated embodiment, the manual-override comprises a rotatable three-way safety valve 59 in communication with line 52, as shown in FIG. 3. In use, should the safety valve 59 be rotated 90° such that the outlet pressure from the left bank pump 34 is vented to atmosphere, the biasing provided by the spring 55 will be overcome, surface **54*b* will be urged against stop 58*b*, a zero (atmospheric) pressure reading will be communicated with the pressure detector 70 (i.e. a flow path will be formed from atmosphere, through valve 59, through port 52, through compartments 57*a* and 57*c*, through port 51, and to the detector 70**), and engine operation will be discontinued.

The engine protective device 10 of the present invention provides substantial benefits. The protective device 10 is adapted to function reliably on an engine with multiple cooling circuits. Should either pump fail, the first and second valves 50, 60, working in combination, will ensure that the pressure gradient across the failed pump is communicated to the detector 70 and engine 20 will be shut down before damage can occur. Thus, the protective device 10 not only provides an accurate signal to the detector 70, but also furnishes an added level of safety in the operation of the engine 20. The claimed protective device 10 also permits both cooling circuits shown in the drawings 32, 42 to be monitored by a single pressure detector 70, which not only eliminates unnecessary components, but reduces overall costs.

I claim as my invention:

1. A protective device for terminating the operation of an internal combustion engine having two banks of cylinders and an associated cooling circuit for each bank, each cooling circuit including a separate coolant pump having an inlet and an outlet to circulate liquid coolant through each bank of the engine by increasing the coolant fluid pressure in the pump outlet relative to the pump inlet, the protective device comprising, in combination:

a pressure detector;

a first valve connected to the outlet of each coolant pump and having a biasing means for communicating the lower of the two pump outlet coolant pressures to the pressure detector;

a second valve connected to the inlet of each coolant pump and having a biasing means for communicating the higher of the two pump inlet coolant pressures to the pressure detector; and an engine shutdown means actuatable by the pressure detector for terminating engine operation should the pressure differential between the outlet pressure communicated to the pressure detector and the inlet pressure communicated to the pressure detector become less than a reference pressure.

2. A protective device as defined in claim 1 wherein the reference pressure varies substantially proportionally with engine speed.

3. A protective device as defined in claim 2 wherein the reference pressure is a cylinder air inlet pressure.

4. A protective device as defined in claim 1 wherein the pressure detector comprises a diaphragm type detector mechanism.

5. A protective device as defined in claim 1 wherein the first valve comprises:

a housing defining a three part chamber, the chamber having a first portion connected to the outlet of one cooling pump, a second portion connected to the outlet of the other cooling pump, and a third intermediate portion connected to the pressure detector, the third portion being disposed between the first and second portions and having a smaller cross-sectional area;

two shoulders within the chamber defined by the intersection of the first and second portions with the intermediate portion;

a valve shuttle disposed within the chamber, the shuttle having a central stem portion and two opposed surfaces, the surfaces being disposed on either end of the stem portion and being substantially perpendicular thereto; and means for biasing the valve shuttle within the chamber.

6. A protective device as defined in claim 5 wherein the means for biasing urges one of the surfaces of the shuttle against one of the shoulders.

7. A protective device as defined in claim 6 wherein the other of said surfaces is urged against the other stop should the outlet pressure of one of the pumps fall below the outlet pressure of the other pump.

8. A protective device as defined in claim 5 wherein the selector valve further comprises means for simulating a pump failure and for terminating engine operation.

9. A protective device as defined in claim 8 wherein the means for simulating a pump failure and for terminating engine operation is a rotatable safety valve disposed between either pump outlet and the selector valve.

10. A protective device as defined in claim 1 wherein the second valve comprises:

a generally cylindrical central chamber, one end of which is fluidically connected to the inlet of one pump, the other end being fluidically connected to the inlet of the other pump; and a valve ball disposed within said chamber so that the ball may freely move between the two ends and is responsive to the inlet pressure from each pump.

* * * * *